US010066489B2

(12) United States Patent
Tanaka et al.

(10) Patent No.: US 10,066,489 B2
(45) Date of Patent: Sep. 4, 2018

(54) ROTATING BODY PROVIDED WITH BLADES

(71) Applicant: KAWASAKI JUKOGYO KABUSHIKI KAISHA, Kobe-shi, Hyogo (JP)

(72) Inventors: Ryozo Tanaka, Kakogawa (JP); Ryoji Tamai, Akashi (JP); Toshiyuki Yamamoto, Kakamigahara (JP); Yoshichika Sato, Kakogawa (JP); Yoshinobu Sakano, Akashi (JP)

(73) Assignee: KAWASAKI JUKOGYO KABUSHIKI KAISHA, Kobe-shi, Hyogo (JP)

( * ) Notice: Subject to any disclaimer, the term of this patent is extended or adjusted under 35 U.S.C. 154(b) by 456 days.

(21) Appl. No.: 14/970,825

(22) Filed: Dec. 16, 2015

(65) Prior Publication Data

US 2016/0102564 A1 Apr. 14, 2016

Related U.S. Application Data

(63) Continuation of application No. PCT/JP2014/066056, filed on Jun. 17, 2014.

(30) Foreign Application Priority Data

Jun. 18, 2013 (JP) ..... 2013-127699

(51) Int. Cl.
*F01D 5/26* (2006.01)

(52) U.S. Cl.
CPC ..... *F01D 5/26* (2013.01); *F05D 2260/961* (2013.01)

(58) Field of Classification Search
CPC . F01D 5/26; F01D 5/027; F01D 25/04; F01D 25/06; F01D 29/328; F01D 29/66;
(Continued)

(56) References Cited

U.S. PATENT DOCUMENTS 6,542,859 B1 4/2003 Burns et al.
2005/0278127 A1 12/2005 Griffin et al.

FOREIGN PATENT DOCUMENTS

CN 101122541 A 2/2008
JP 60-025670 A 2/1985
(Continued)

OTHER PUBLICATIONS

Communication, dated May 25, 2016, from the State Intellectual Property Office of the P.R.C., in counterpart Chinese application No. 201480034405.5.

(Continued)

*Primary Examiner* — Richard Edgar
(74) *Attorney, Agent, or Firm* — Sughrue Mion, PLLC

(57) ABSTRACT

A rotating body includes a rotating body core, and a plurality of blades provided at an outer or inner circumference of the rotating body core at equal intervals in a circumferential direction, and connected circumferentially via an annular connection portion provided separately from the rotating body core. A resonance frequency under a two nodal diameter number mode of the rotating body is lower than or equal to a rotational secondary harmonic frequency with respect to a rated rotation speed. Where $N_d$ represents an order of a maximum mistuned component among order components of circumferential distribution of mass, rigidity or natural frequency of the blades, arrangement of the blades satisfies $N_d \geq 5$, and has order components each having ratio less than 1/2, in which the ratio is obtained by dividing the order component by the magnitude of the component of the order $N_d$.

8 Claims, 19 Drawing Sheets

(58) Field of Classification Search
CPC .... F01D 29/661; F01D 29/662; F01D 29/666; F01D 29/668; F05D 2260/96; F05D 2260/961
See application file for complete search history.

(56) References Cited

FOREIGN PATENT DOCUMENTS

| | | | | |
|---|---|---|---|---|
| JP | 07-004203 | A | | 1/1995 |
| JP | 07-279606 | A | | 10/1995 |
| JP | 10-47007 | A | | 2/1998 |
| JP | 10047007 | A | * | 2/1998 |
| JP | 2002-221003 | A | | 8/2002 |
| JP | 2011-051371 | A | | 3/2011 |

OTHER PUBLICATIONS

Communication dated Jan. 16, 2017 issued by the Intellectual Property Office of Canada in Corresponding Application No. 2,915,801.
Communication dated Feb. 15, 2017 issued by the European Patent Office in Corresponding application No. 14814030.4.
International Preliminary Report on Patentability issued from the International Bureau in counterpart International application No. PCT/JP2014/066056, dated Dec. 30, 2015.
International Search Report for PCT/JP2014/066056 dated Sep. 9, 2014 [PCT/ISA/210[.
Decision of Grant dated Mar. 18, 2014 on Corresponding JP Appln. No. 2013-127699.

* cited by examiner

ROTATING BODY PROVIDED WITH BLADES

CROSS REFERENCE TO THE RELATED APPLICATION

This application is a continuation application, under 35 U.S.C. § 111(a), of international application No. PCT/JP2014/066056, filed Jun. 17, 2014, which claims priority to Japanese patent application No. 2013-127699, filed Jun. 18, 2013, the disclosure of which are incorporated by reference in their entirety into this application.

BACKGROUND OF THE INVENTION

Field of the Invention

The present invention relates to a rotating body provided with a plurality of blades, such as a turbine rotor for a gas turbine engine or a steam turbine, and more particularly to an arrangement structure of the blades in the rotating body.

Description of Related Art

A rotating body for use in turbomachinery such as a gas turbine engine or a jet engine rotates at a high speed, with a large number of turbine rotor blades being arranged at equal intervals on an outer circumferential portion of a rotor. When the multiple rotor blades are manufactured, occurrence of variations (mistuning) in mass, rigidity, and natural frequency among the rotor blades is unavoidable. Depending on the arrangement of the rotor blades, critical vibration may occur in the rotor blades due to influence of resonance caused by such mistuning. In addition, the mistuning may cause resonance at a vibration frequency or in a vibration mode, which are outside a design plan. Such vibration may cause a reduction in the life of the blades.

In order to suppress the vibration due to the variation in mass of the rotor blades, there have been proposed, for example, a method in which an amount of unbalance around a rotation axis is adjusted by arranging rotor blades at opposed diagonal positions on the circumference of a rotor, successively in order from a rotor blade having a larger mass (e.g., Patent Document 1), and a method in which rotor blades are arranged on the basis of natural frequencies measured for the respective rotor blades (e.g., Patent Document 2).

RELATED DOCUMENT

Patent Document

[Patent Document 1] JP Laid-open Patent Publication No. S60-025670

[Patent Document 2] JP Laid-open Patent Publication No. H10-047007

SUMMARY OF THE INVENTION

However, in the method of simply arranging the rotor blades on the circumference successively in order from a rotor blade having a larger mass or natural frequency or the method of arranging, at unequal intervals, abnormal blades having masses and/or natural frequencies deviating from the average values, even though a grouped blade structure (infinite grouped blades) in which blades are connected over the entire circumference is achieved, the effect of suppressing vibration is not sufficient, and such problems still remain as a reduction in the life of the rotor blades due to vibration, and an increase in a frequency range in which resonance should be avoided.

Therefore, in order to solve the above-described problem, an object of the present invention is, in a rotating body having a grouped blade structure over the entire circumference thereof, to suppress or avoid resonance caused by mistuning by intentionally arranging mistuned components of masses or the like of a plurality of blades provided at equal intervals on a rotating body core.

In order to achieve the above object, a rotating body provided with a plurality of blades according to a first configuration of the present invention, includes: a rotating body core; and a plurality of blades provided at an outer circumference or an inner circumference of the rotating body core at equal intervals in a circumferential direction. The plurality of blades form a grouped blade structure in which the blades are connected over the entire circumference via an annular connection portion provided separately from the rotating body core. A resonance frequency under a two nodal diameter number mode of the rotating body is lower than or equal to a rotational secondary harmonic frequency with respect to a rated rotation speed of the rotating body. When an order of a maximum mistuned component is defined as $N_d$ among order components of mass distribution, rigidity distribution, or natural frequency distribution of the plurality of blades in the circumferential direction, the plurality of blades are arranged so as to satisfy $N_d \geq 5$, and arranged so as to have order components each having a ratio less than ½ , in which the ratio is obtained by dividing the order component by a magnitude of the component of the order $N_d$.

According to the above configuration, the amplitude at resonance is suppressed from being increased due to mistuned components. In addition, regarding particularly critical resonances having nodal diameter number of one and nodal diameter number of two among critical resonances in which a vibration mode, in which a distribution pattern (nodal diameter number) of an exciting force coincides with a vibration pattern (nodal diameter number) of a disk mode of the rotating body, strongly resonates with the exciting force, it is possible to realize, particularly effectively, suppression of the resonance increasing effect due to mistuning and easy avoidance of the critical resonances.

In order to achieve the above configuration, a rotating body provided with a plurality of blades according to a second configuration of the present invention, includes: a rotating body core; and a plurality of blades provided at an outer circumference or an inner circumference of the rotating body core at equal intervals in a circumferential direction. The plurality of blades form a grouped blade structure in which the blades are connected over the entire circumference via an annular connection portion provided separately from the rotating body core. A resonance frequency under a two nodal diameter number mode of the rotating body is higher than a rotational secondary harmonic frequency with respect to a rated rotation speed of the rotating body. When an order of a maximum mistuned component is defined as $N_d$ among order components of mass distribution, rigidity distribution, or natural frequency distribution of the plurality of blades in the circumferential direction, the plurality of blades are arranged so as to satisfy $N_d \geq 6$, and arranged so as to have order components each having a ratio less than 1/2, in which the ratio is obtained by dividing the order component by a magnitude of the component of the order $N_d$.

According to the above configuration, the amplitude at resonance is suppressed from being increased due to mistuned components. In addition, regarding particularly critical critical resonances having nodal diameter number of one and nodal diameter number of two among critical resonances in which a vibration mode, in which a distribution pattern (nodal diameter number) of an exciting force coincides with a vibration pattern (nodal diameter number of the mode) of a disk mode of the rotating body, strongly resonates with the exciting force, it is possible to realize, particularly effectively, suppression of the resonance increasing effect due to mistuning and easy avoidance of the critical resonances.

In the rotating body according to one embodiment of the present invention, each of the blades may be formed separately from the rotating body core and from adjacent blades, and may be implanted so as to be arrayed in a circumferential direction of an outer circumference of the rotating body core, or may be implanted so as to be arrayed in a circumferential direction of an inner circumference of the rotating body core.

The above configurations facilitate management of quality of the blades having variations in mass, rigidity, natural frequency, and the like due to reasons in manufacture. Further, the configurations also facilitate intentional arrangement of the nodal diameter number $N_d$ of the mass distribution, rigidity distribution, or natural frequency distribution as described above. Further, the configurations also facilitate balancing of the center of gravity of the rotating body.

As described above, according to a rotating body provided with a plurality of blades according to the present invention, distribution of masses or the like of a plurality of blades provided at a rotating body core of the rotating body is intentionally formed, whereby it is possible to effectively suppress increase in blade array vibration due to variation (mistuning) in mass or the like, and resonance at a frequency which is unexpected in a tuned rotating body having uniform mass, rigidity, or the like.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF EMBODIMENTS

Hereinafter, an embodiment of the present invention will be described with reference to the drawings.

Figure 1:
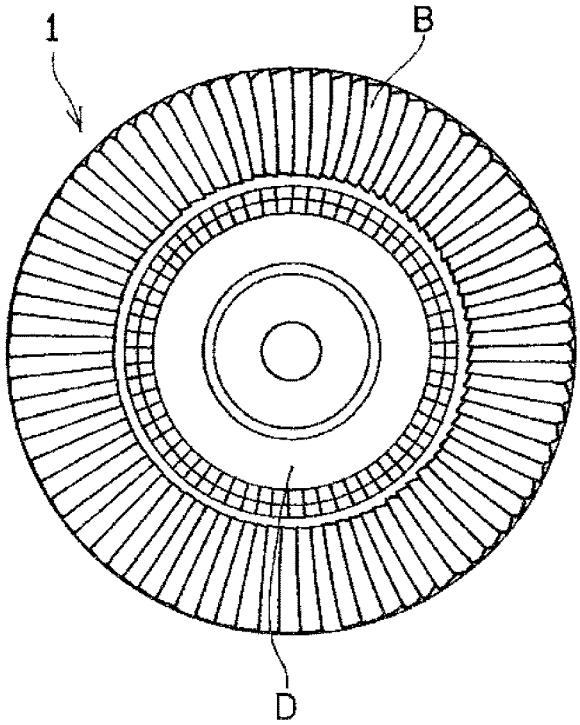
FIG. 1 is a front view of a rotating body (turbine rotor) according to an embodiment of the present invention.

FIG. 1 shows a turbine rotor 1 of a gas turbine engine, which is a rotating body according to an embodiment of the present invention. In FIG. 1, the turbine rotor 1 includes a rotating body core D forming a radially inner portion thereof, and a plurality of blades (in this example, turbine rotor blades) B provided on an outer circumferential portion of the rotating body core D, at equal intervals in the circumferential direction. The turbine rotor 1 of the present embodiment is configured as a tip shroud type rotor in which outer-diameter-side end portions of the plurality of rotor blades B are connected by means of an arc-shaped connection piece to form a shroud. In the example of FIG. 1, the turbine rotor 1 has $N_b$ (=74) of rotor blades B.

In the present embodiment, the turbine rotor blades B are arranged so that a value of nodal diameter number $N_d$ in mass distribution, rigidity distribution, or natural frequency distribution of the turbine rotor blades B is within a predetermined range, thereby suppressing a resonance increasing effect caused by mistuned components. Further, this arrangement of the turbine rotor blades B facilitates a reduction in the risk of damage which may be caused by a phenomenon unexpected in a tuned rotor, such as an increase in a frequency range not to be used for the tuned rotor, or a change in the frequency at which resonance occurs. In the following description, mass distribution of the turbine rotor blades B will be mainly described as a representative example.

Hereinafter, the nodal diameter number $N_d$ in the mass distribution of the turbine rotor blades B will be described. In this specification, order components of the mass distribution and the nodal diameter number $N_d$ are defined as follows. The mass distribution can be represented by the sum of components of a sinusoidal wave having n (n=positive integer) cycles per round. That is, assuming that the mass of the k-th blade is $m_k$, the mass $m_k$ can be expressed by the following equation (1) which is a complex form of Fourier series with an imaginary unit represented by i.

$$m_k = M_0 + \sum_{n=1}^{N_b} \hat{M}_n \exp\left[i \cdot \frac{2\pi n}{N_b}(k-1)\right], k = 1, 2, \ldots, N_b \quad (1)$$

In the above equation, $M_0$ is a real number, and represents an average mass. $\hat{M}_n$ is a complex number, generally referred to as a n-th order complex amplitude, and has information of the magnitude and phase of an n-th order component. In addition, n is referred to as an order. The magnitude (actual amplitude $M_n$) of the n-th order component is represented by an absolute value of $\hat{M}_n$ and therefore, is expressed by the following equation (2).

$$M_n = |\hat{M}_n| = \sqrt{\{Re[\hat{M}_n]\}^2 + \{Im[\hat{M}_n]\}^2} \quad (2)$$

In the present embodiment, an order at which a maximum component appears, which is obtained by subjecting the mass distribution to Fourier series expansion, is defined as the nodal diameter number $N_d$. However, in order to avoid the situation that a characteristic other than the nodal diameter number $N_d$ becomes strong and consequently the vibration characteristic of the rotating body becomes complicated or the vibration response is increased, if a component having a ratio larger than or equal to 1/2, in which the ratio is obtained by dividing the component by the magnitude of the component of the order $N_d$, is included in all the order components excluding a component of $N_d$=0 as an average component, it is regarded that there is no outstanding order component and therefore no nodal diameter number $N_d$ can be defined. $N_d$=0 represents a tuned rotor having uniform mass distribution. The equations (1) and (2) are each expressed by a complex form of Fourier series, but may be expressed by a trigonometric function form of Fourier series. Also in this case, the nodal diameter number $N_d$ of the mass distribution is similarly defined.

Figure 2:
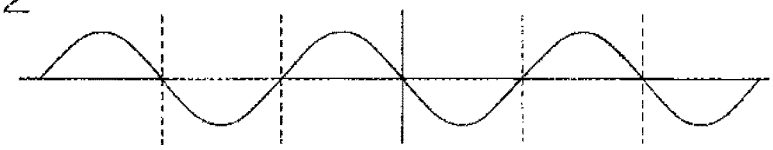
FIG. 2 is a graph showing an example of a sinusoidal wave.
Figure 3:
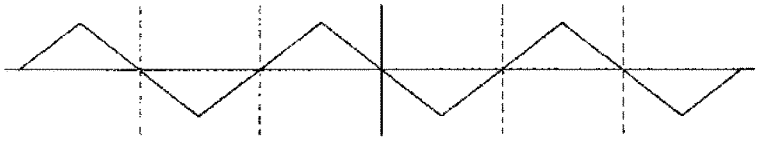
FIG. 3 is a graph showing an example of a triangle wave.
Figure 4:
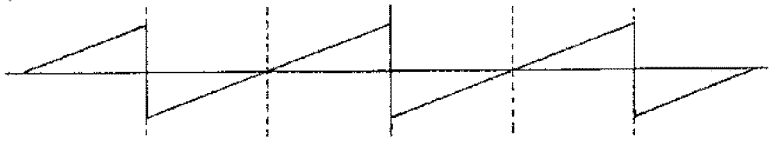
FIG. 4 is a graph showing an example of a sawtooth wave.

Regarding vibration of rotor blades constituting a tuned rotating body, a vibration wave propagating between adjacent blades is not reflected during the propagation, and continues to propagate over the entire circumference while being attenuated, thereby forming an exactly circumferentially periodic response in the rotating body. On the other hand, in a mistuned rotating body, since a vibration wave propagates while repeating reflection caused by mistuning, and transmission, the rotating body becomes to have a characteristic like a finite group of blades, which may cause the vibration to be partially increased, or the vibration characteristic to be complicated. In order to suppress the behavior like the finite group of blades, it is effective to arrange the blades so that the vibration characteristic between adjacent blades smoothly changes to prevent strong reflection. Specifically, for example, an arrangement close to a sinusoidal wave or a triangle wave is preferred to a sawtooth-wave like arrangement, and the vibration characteristic is simplified. These three waveforms are each subjected to Fourier series expansion, and a ratio between the magnitude of the maximum component and the magnitude of the second maximum component is calculated. The ratio is 0 for the sinusoidal wave which is composed of only a single component, 1/9 for the triangle wave, and 1/2 for the sawtooth wave which has a steep change. FIG. 2, FIG. 3, and FIG. 4 show specific examples of the sinusoidal wave, the triangle wave, and the sawtooth wave, respectively.

Further, mathematically, a smaller term (component) of Fourier series may represent gentleness of change in arrangement of mass or the like. However, a vibration mode having a smaller nodal diameter number is likely to have a smaller modal rigidity. Further, an exciting force that makes critical resonance with the vibration mode is likely to be greater in the case of a nodal diameter number component of a smaller order. Therefore, a mistuned component of a smaller order tends to greatly affect the vibration characteristic of the rotating body, as compared to a mistuned component of a greater order. Therefore, in the present embodiment, the order components are sufficiently reduced as compared to the nodal diameter number $N_d$ as the maximum component, specifically, reduced to less than 1/2, regardless of the magnitude of each order.

Figure 5:
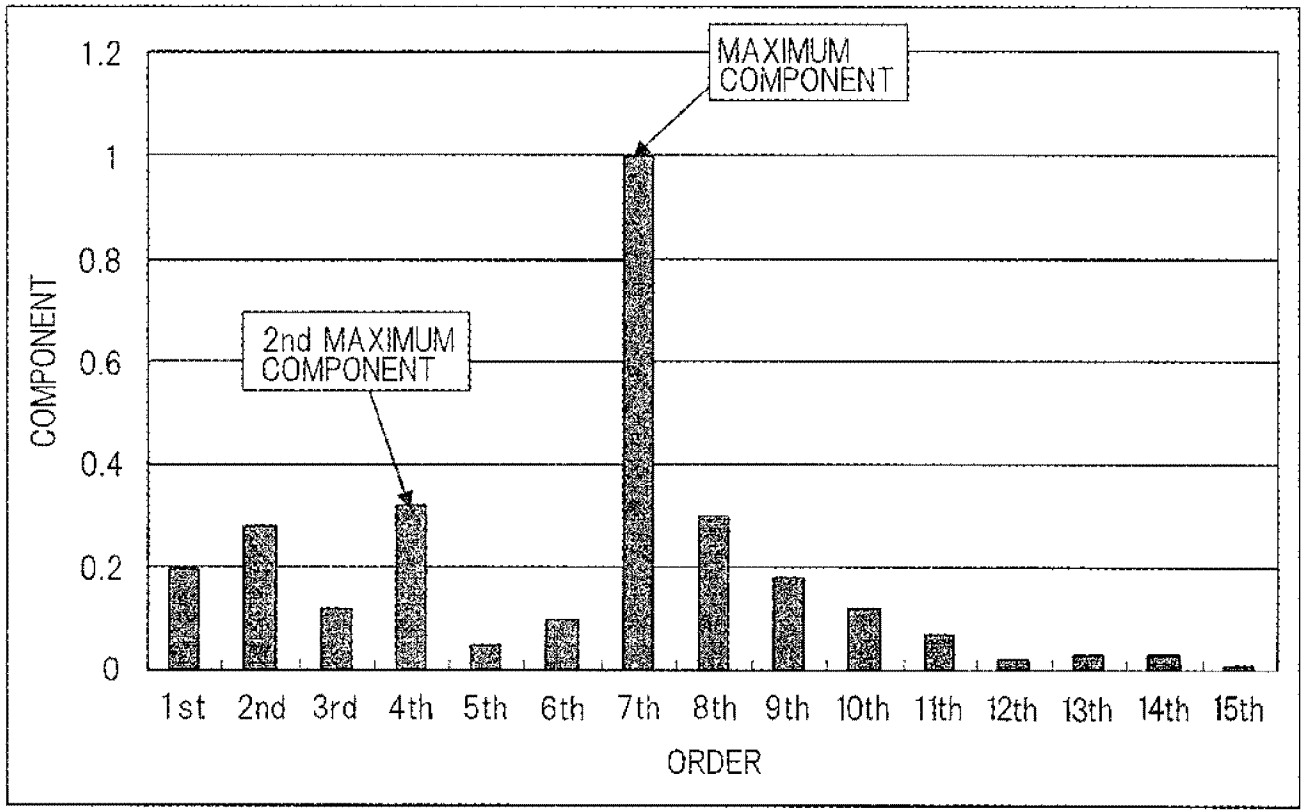
FIG. 5 is a graph showing an example of Fourier series expansion in a case where a nodal number can be defined.
Figure 6:
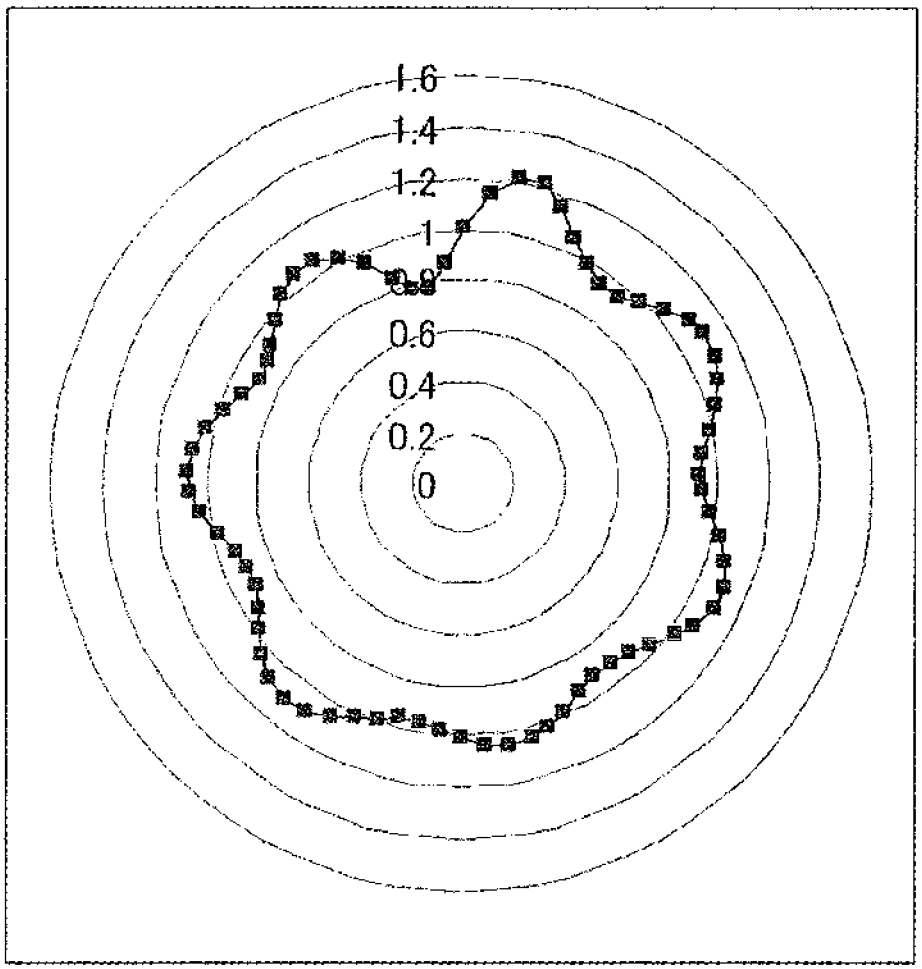
FIG. 6 is a graph showing an example of mass distribution of rotor blade arrangement in a case where a nodal number can be defined.
Figure 7:
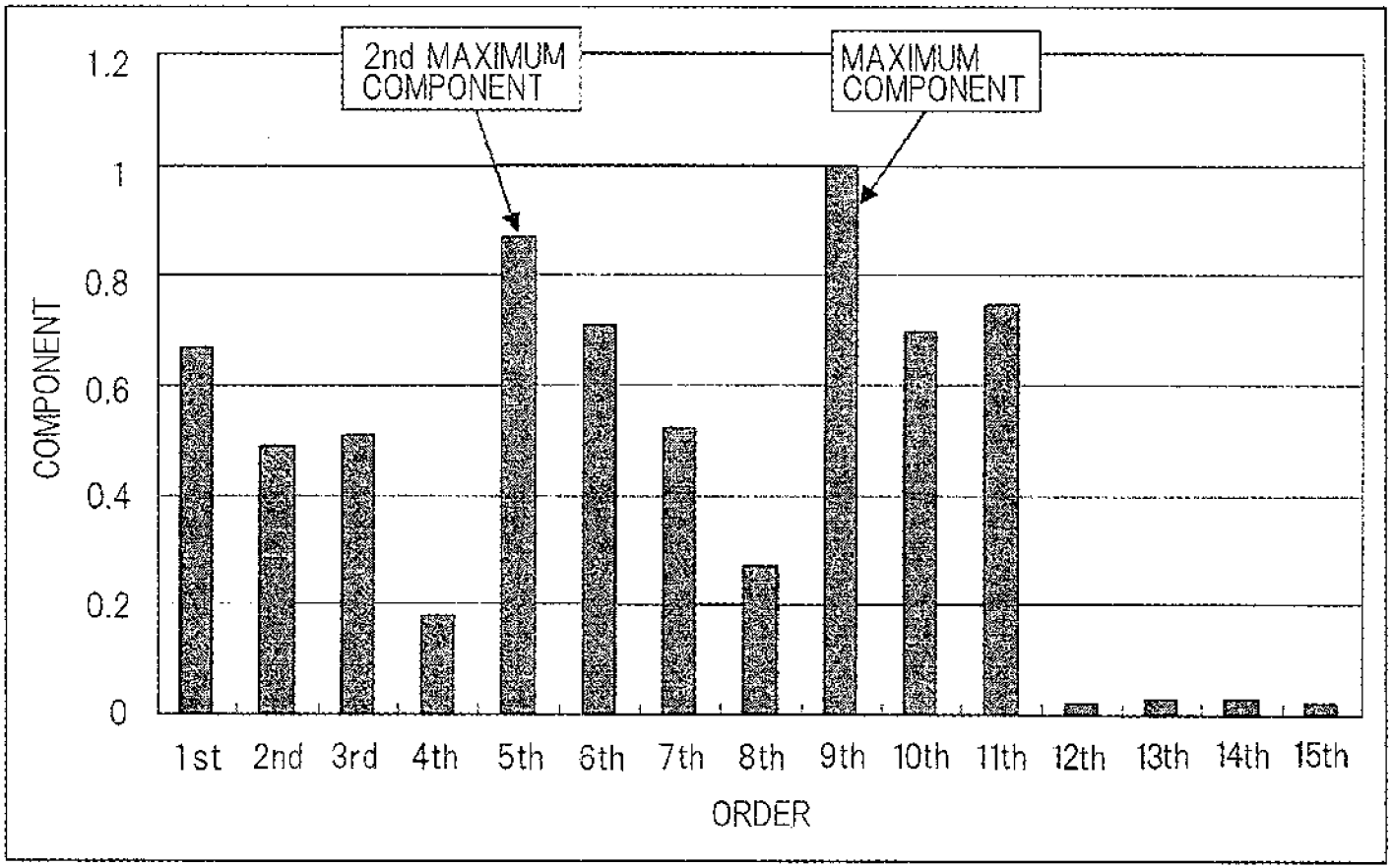
FIG. 7 is a graph showing an example of Fourier series expansion in a case where a nodal number cannot be defined.
Figure 8:
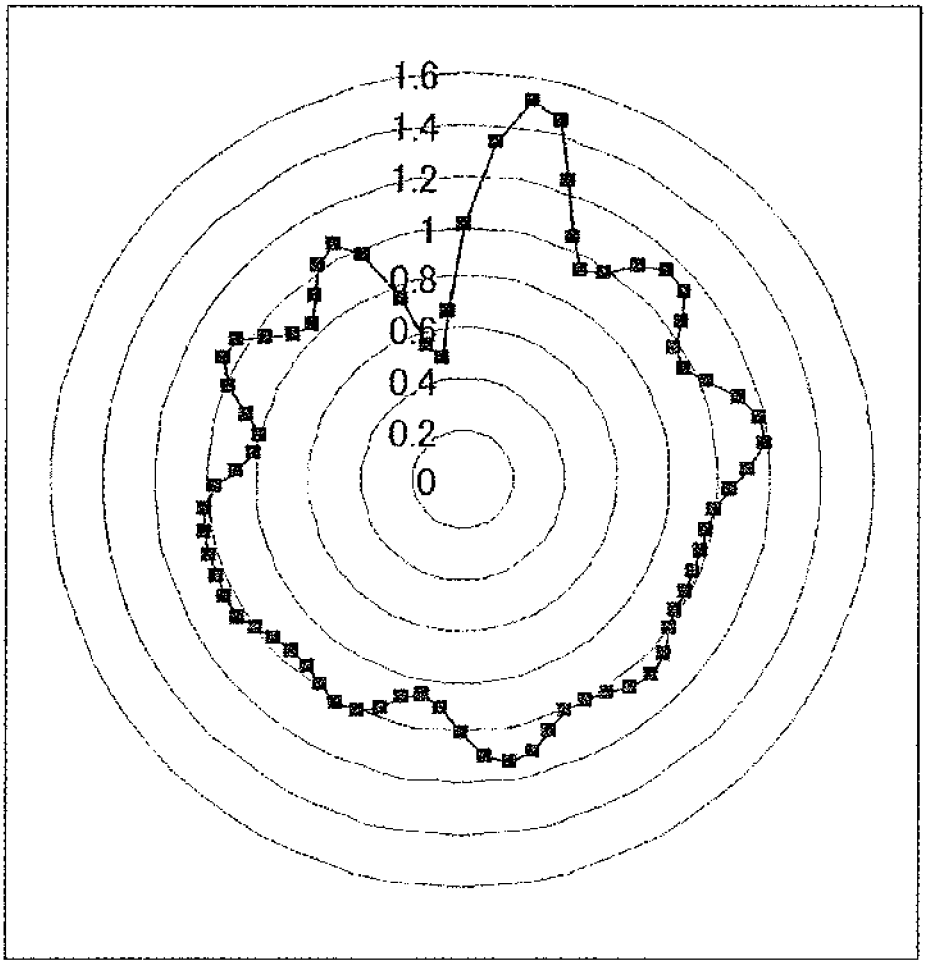
FIG. 8 is a graph showing an example of mass distribution of rotor blade arrangement in a case where a nodal number cannot be defined.

Hereinafter, an example of a result of Fourier series expansion performed on blade mass distribution will be described. FIG. 5 is a graph showing a result of Fourier series expansion of blade mass distribution shown in FIG. 6, which is normalized with the magnitude of the 7th-order component which is the maximum component. In this example, while the magnitude of the 7th-order component as the maximum component is 1, the second maximum component is the 4th-order component, and the magnitude thereof is less than 1/2 (0.32). Therefore, the nodal diameter number $N_d$ of mass distribution is defined as 7. On the other hand, FIG. 7 shows an example of Fourier series expansion of mass distribution shown in FIG. 8. In this example, while the magnitude of the 9th-order component as the maximum component is 1, order components each having a magnitude exceeding 1/2 of the magnitude of the maximum component are included. In this case, it is regarded that there is no outstanding component, and therefore, no nodal diameter number $N_d$ can be defined.

In the present embodiment, the blades are arranged so that the nodal diameter number $N_d$ satisfies $N_d \geq 5$ or $N_d \geq 6$. As described later, the larger the nodal diameter number $N_d$ is, the more the resonance increasing effect due to mistuning is suppressed, which is an advantage. However, an upper limit value of $N_d$ theoretically satisfies $N_d \leq N_b/2$, and $N_d \leq 37$ in the example shown in FIG. 1. In addition, in an actual rotating body having variation in mass or the like, generally, if $N_d$ is set to be large, it becomes difficult to satisfy the above-mentioned condition for the component ratio. Although it depends on the degree of variation, in the example of FIG. 1, a practically standard upper limit of $N_d$ satisfies $N_d \leq$ about 10 to 15. Further, since a blade that does not satisfy the above-mentioned condition for the component ratio and a blade that does not conform to the desired arrangement are to be discarded or require treatment such as mending, these blades cause an increase in the production cost. Therefore, taking into account the production cost, it is more advantageous that the value of $N_d$ to be selected is closer to 5 or 6. Considering the above, the practical range of $N_d$ is $5 \leq N_d \leq 10$ to 15.

Figure 9:
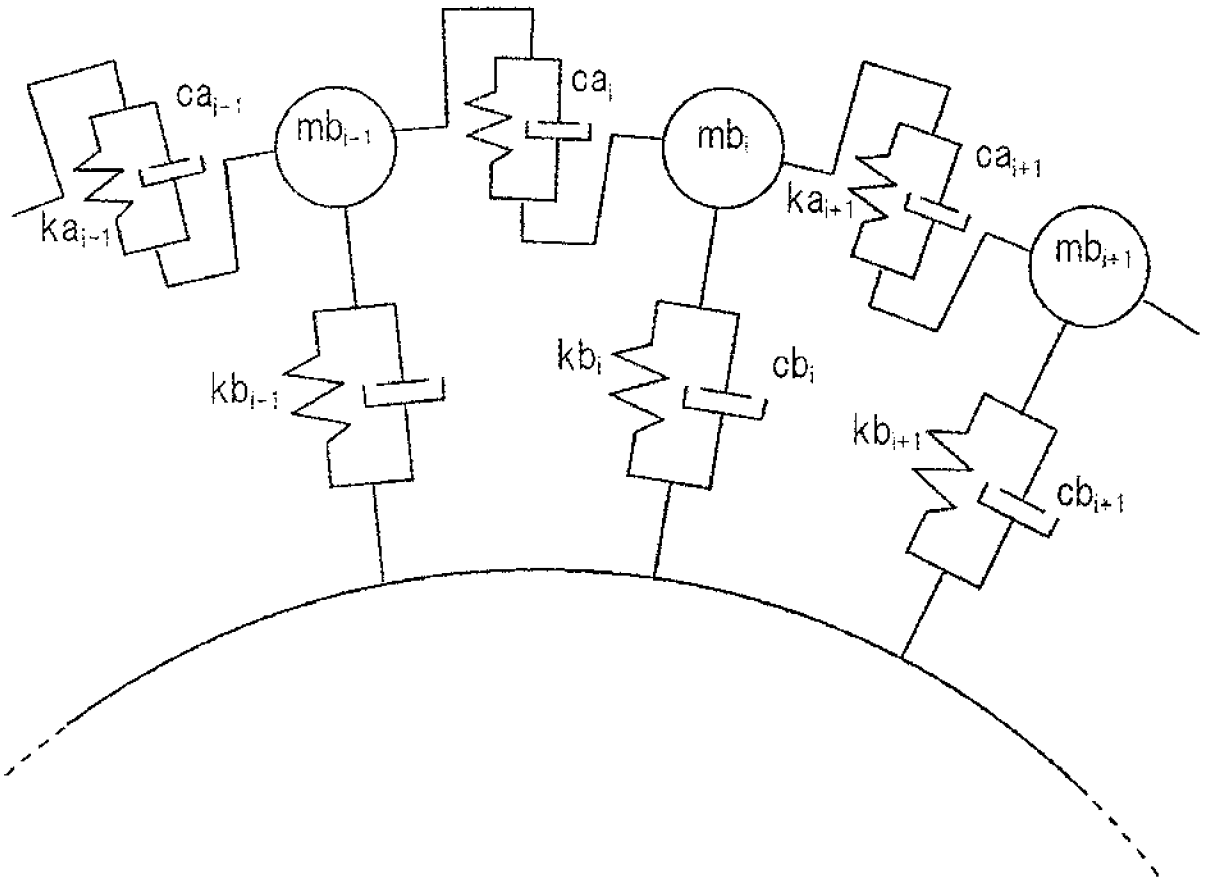
FIG. 9 is a block diagram showing a vibration analysis model of the turbine rotor of FIG. 1.

Hereinafter, a method of arranging the turbine rotor blades B to reduce vibration thereof, i.e., the optimum setting range of the nodal diameter number $N_d$, will be described on the basis of a result of vibration analysis. FIG. 9 shows a vibration analysis model for the rotating body core D and the rotor blades B of the turbine rotor 1 shown in FIG. 1. The turbine rotor 1 of the present embodiment is configured as a tip shroud type rotor in which the outer-diameter-side end portions of the plurality of rotor blades B are connected by means of an arc-shaped connection piece to form a shroud. Such blades are referred to as tip shroud blades. In FIG. 9, m represents an equivalent mass of a blade, k represents an equivalent rigidity of the blade, and c represents an equivalent attenuation coefficient of the blade. In addition, a subscript "a" ($ka_{i-1}$ to $ka_{i+1}$, $ca_{i-1}$ to $ca_{i+1}$) means that a value with this subscript is a value of an outer-diameter-end shroud portion connected to an adjacent rotor blade B. A subscript "b" ($mb_{i-1}$ to $mb_{i+1}$, $kb_{i-1}$ to $kb_{i+1}$, $cb_{i-1}$ to $cb_{i+1}$) means that a value with this subscript is a value of a blade body portion of each rotor blade B.

Regarding the vibration analysis model shown in FIG. 9 indicating the tip shroud blades, a case will be described where a mistuned component is the mass of the rotor blade. For simplification, an example in which a mistuned component is restricted to a component of the nodal diameter number $N_d$ will be considered. In this case, with the average value $M_0$ being a median, and variation in the equivalent mass being $M_n$ shown in the equation (2), distribution of the masses of the blades of the rotating body, which distribute in a sinusoidal wave pattern with the nodal diameter number $N_d$ in the circumferential direction of the rotating body, is represented by the following equation (3).

$$m_k = M_0 + M_n \mathrm{Im}\left[\exp\left[i \cdot \frac{2\pi N_d}{N_b}(k-1)\right]\right], \quad k = 1, 2, \ldots, N_b \qquad (3)$$
$$= M_0 + M_n \sin\left[\frac{2\pi N_d}{N_b}(k-1)\right]$$

Figure 10:
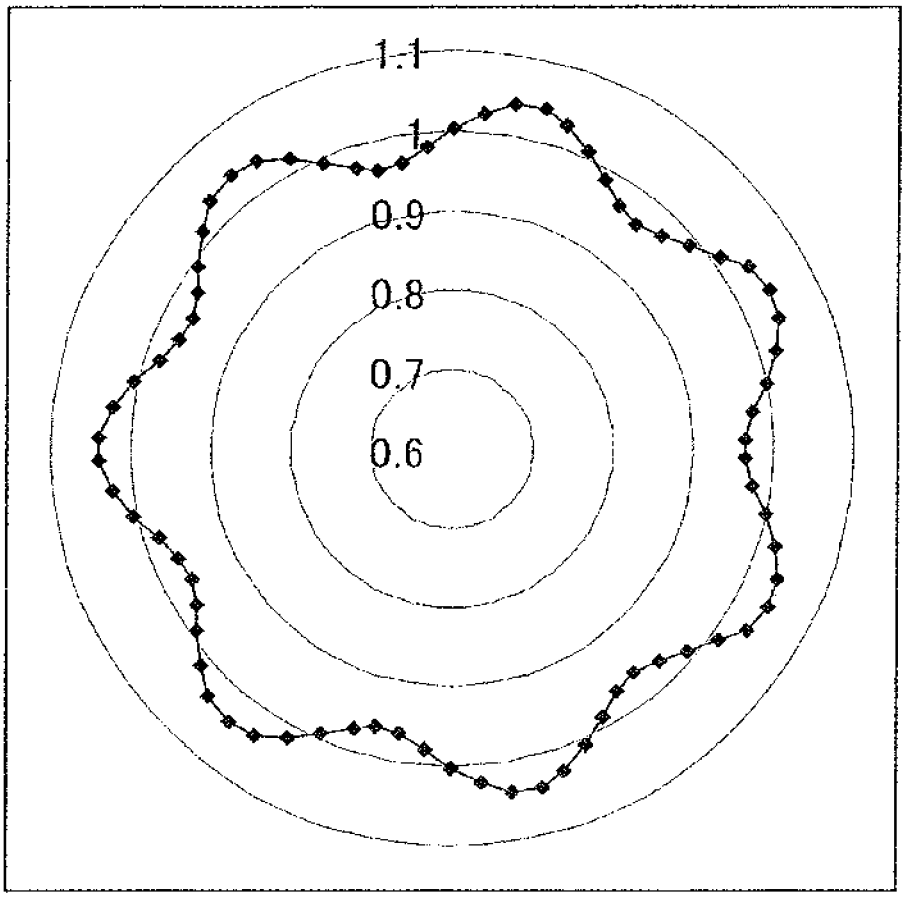
FIG. 10 is a graph showing an example of mass distribution ($N_d$=7) of the vibration analysis model.

When the mistuned component is the rigidity or the natural frequency, m and M are replaced with the equivalent rigidity or the equivalent natural frequency, respectively, as expressed in the form of the equation (3). FIG. 10 shows an example of mass distribution with the nodal diameter number $N_d$=7.

Generally, fluid that flows into the rotor blades B has an uneven flow rate or pressure in the circumferential direction of the rotating body. This uneven distribution, in the case of a gas turbine, for example, is caused by the number of combustors, the number of struts, distortion of casing, drift, or the like. The rotor blades B are subjected to pressure variation due to the uneven flow of the fluid in the circumferential direction of the rotating body, and relative motions of the flowing liquid and the rotating turbine rotor 1 in the rotation direction. This pressure variation is input to the rotor blades B as an exciting force. In a lot of fluid machinery having turbines and compressors, exciting force components having the nodal diameter number of one and the nodal diameter number of two are likely to be particularly strong due to eccentricity of a rotational shaft, distortion of casing, drift, and the like.

Like the mass distribution or the like, distribution of the exciting force over the entire circumference of the turbine rotor 1 can also be expressed by Fourier series, and therefore, can be represented as the sum of exciting force components distributing in a sinusoidal wave pattern. When the rotation speed of the rotor is the first order of the harmonic frequency, the orders of the multiple components thereof, e.g., the first order, the second order, and the third order, represent harmonic frequency and nodal diameter number of a fluid force distribution that excites the rotating body.

Figure 11:
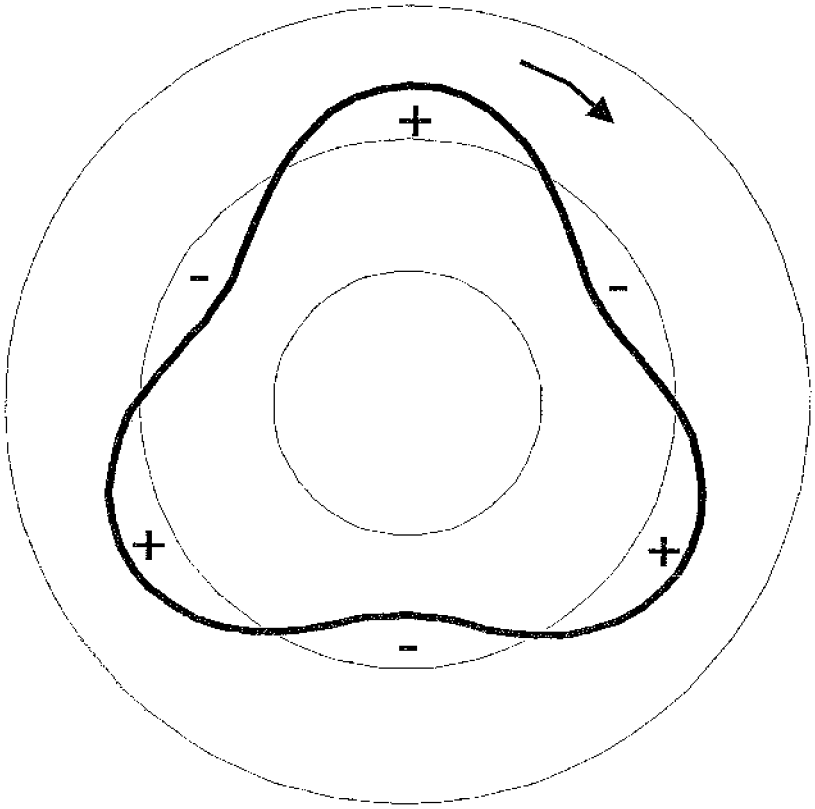
FIG. 11 is a graph showing an example of distribution ($N_f$=3) of an excitation force.

When, among the components constituting the exciting force, the exciting force of the nodal diameter number $N_f$ excites the rotor blades B while rotating relative to the rotor blades B, an exciting force $F_{n,k}$ applied to the k-th rotor blade is expressed by the following equation (4). In the equation (4), the exciting force$F_{n,k}$ is a complex number, and a real part and an imaginary part thereof represent the state where the exciting force excites the rotor blades while rotating relative to the rotor blades. In addition, $F_n$ indicates the amplitude of the exciting force, and $\phi_n$ indicates the initial phase of the exciting force at the first rotor blade (k=1). FIG. 11 shows an example of exciting force distribution with the nodal diameter number $N_f$=3. In FIG. 11, an arrow indicates relative rotation of the exciting force distribution as viewed from the rotor blades.

$$F_{n,k} = F_n \exp\left[i \cdot \left(\frac{2\pi N_f}{N_b}(k-1) + \phi_n\right)\right], \quad k = 1, 2, \ldots, N_b \qquad (4)$$

Based on the equation (3), a tuned rotating body model (blade number $N_b$=74, nodal diameter number $N_d$=0 for equivalent mass distribution), and a mistuned rotating body model (blade number $N_b$=74, nodal diameter number $N_d \neq 0$ for equivalent mass distribution) were formed, and a blade vibration response was calculated for each model by giving an exciting force of the nodal diameter number $N_f$. The degree of variation in the equivalent mass was 4% of $M_0$.

Figure 12:
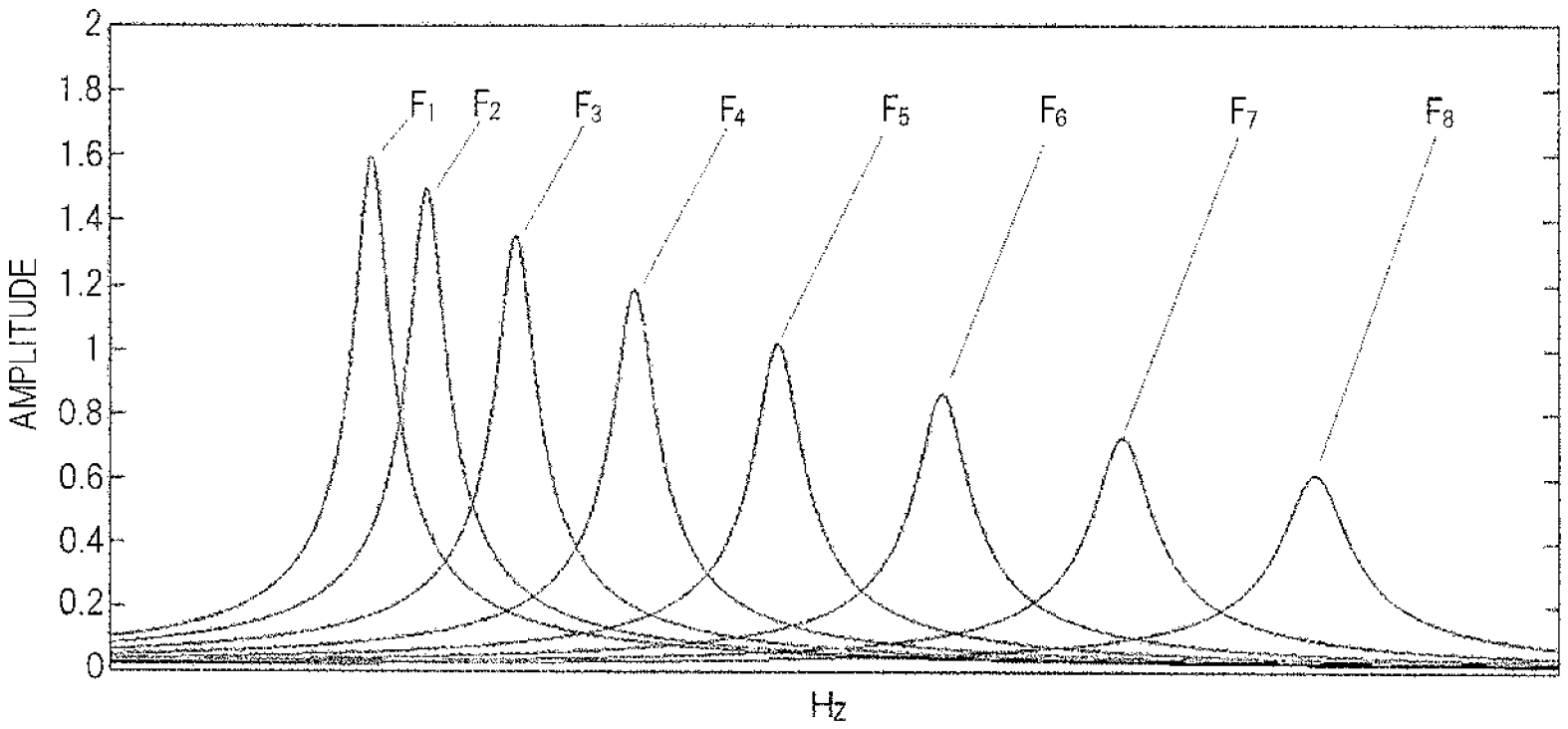
FIG. 12 is a graph showing an example of vibration response curves with respect to a tuned rotating body.

When vibration response analysis was executed under the above conditions, the following results were obtained. FIG. 12 is a graph showing vibration response characteristic curves for the respective exciting forces ($F_1$ to $F_8$) applied to a tuned turbine rotor having no variation in mass distribution. In the graph of FIG. 12, the horizontal axis represents the excitation frequency, and the vertical axis represents the magnitude of vibration response of the rotor blades.

Figure 13:
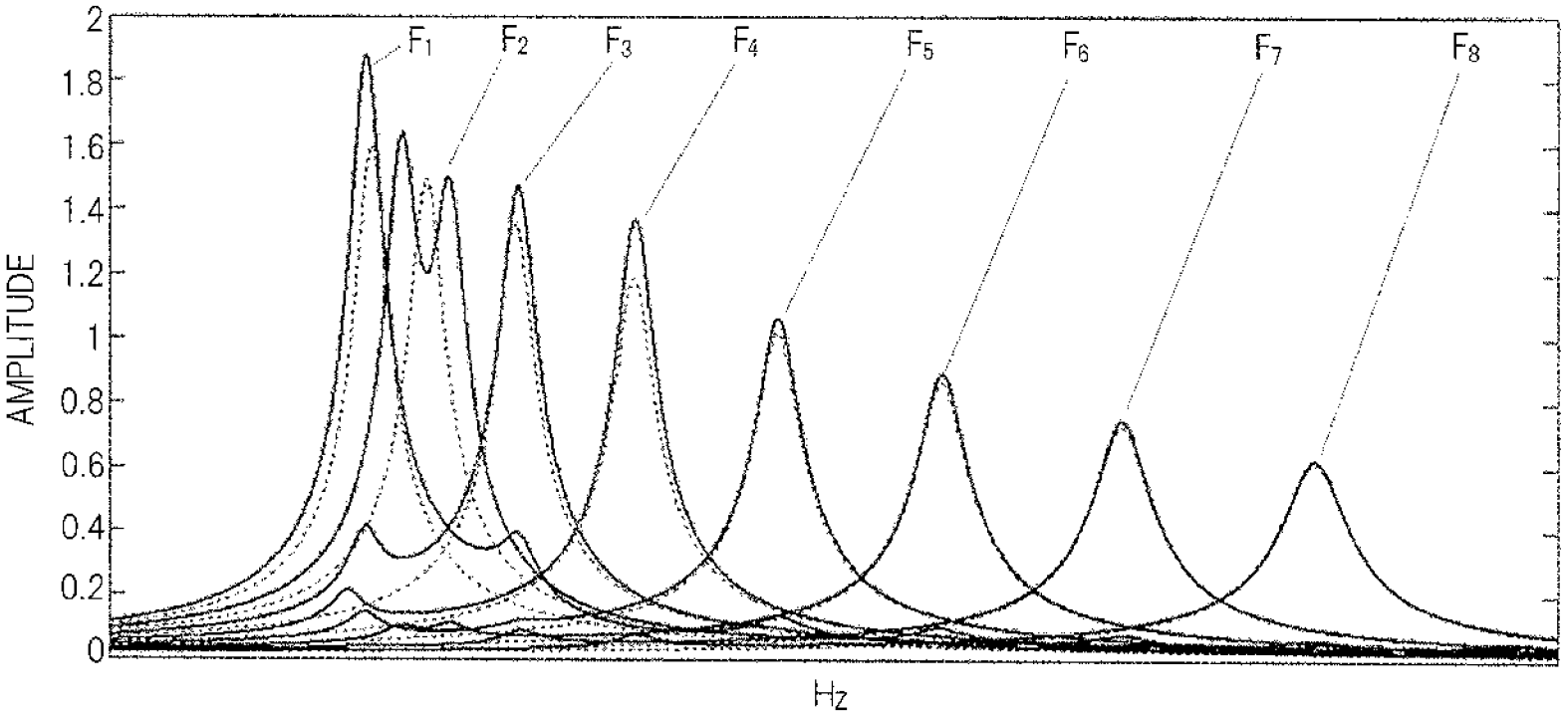
FIG. 13 is a graph showing an example of vibration response curves with respect to a rotating body having nodal diameter number $N_d$=4 for blade mass distribution.
Figure 14:
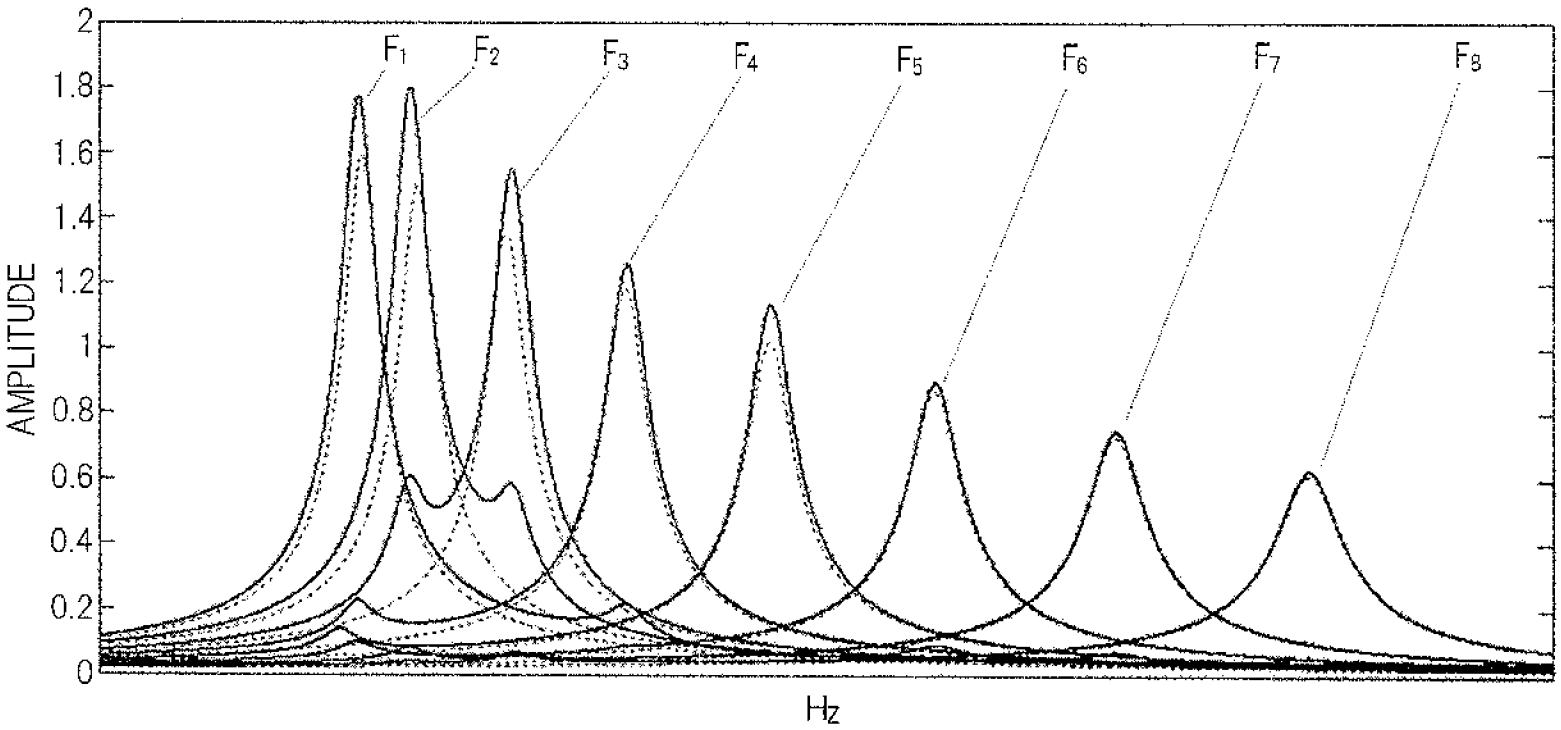
FIG. 14 is a graph showing an example of vibration response curves with respect to a rotating body having nodal diameter number $N_d$=5 for blade mass distribution.
Figure 15:
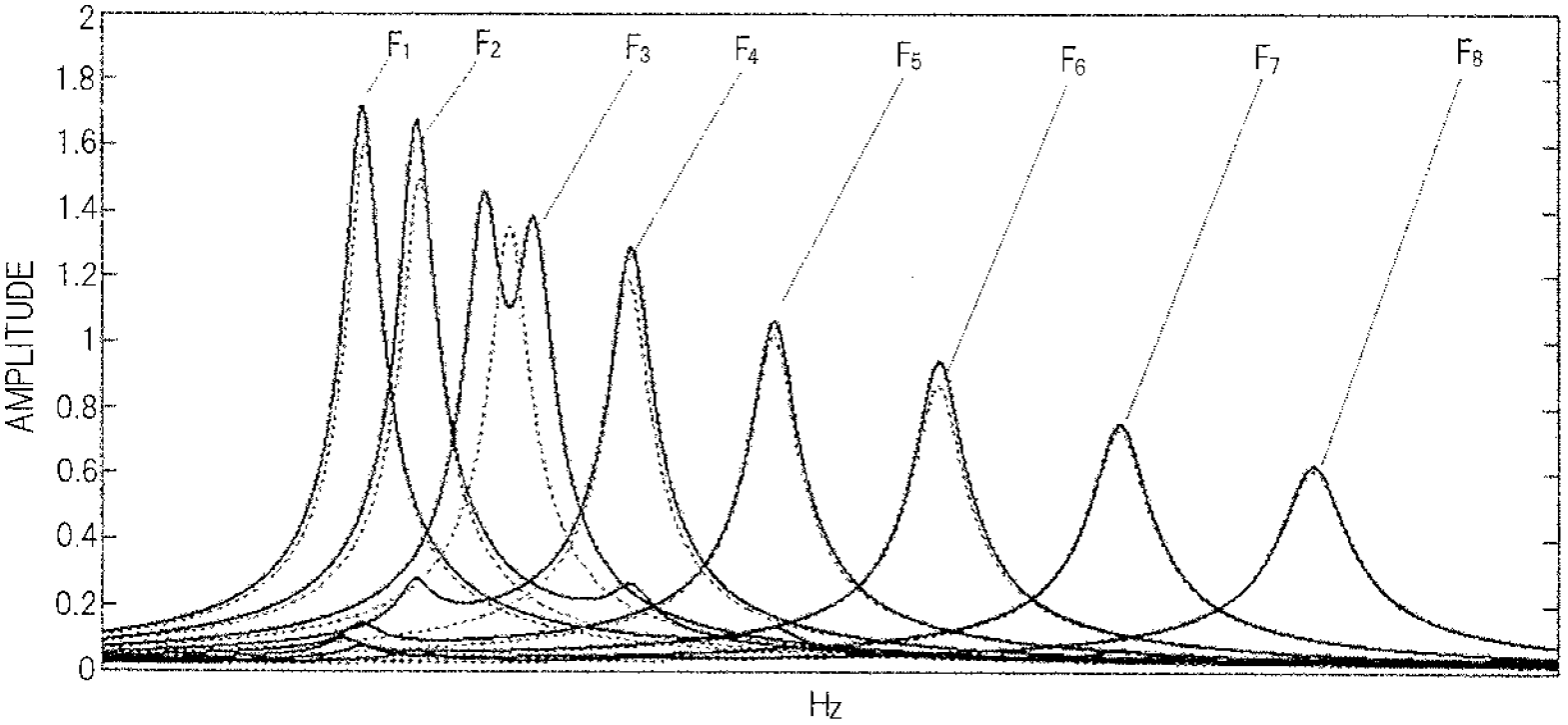
FIG. 15 is a graph showing an example of vibration response curves with respect to a rotating body having nodal diameter number $N_d$=6 for blade mass distribution.
Figure 16:
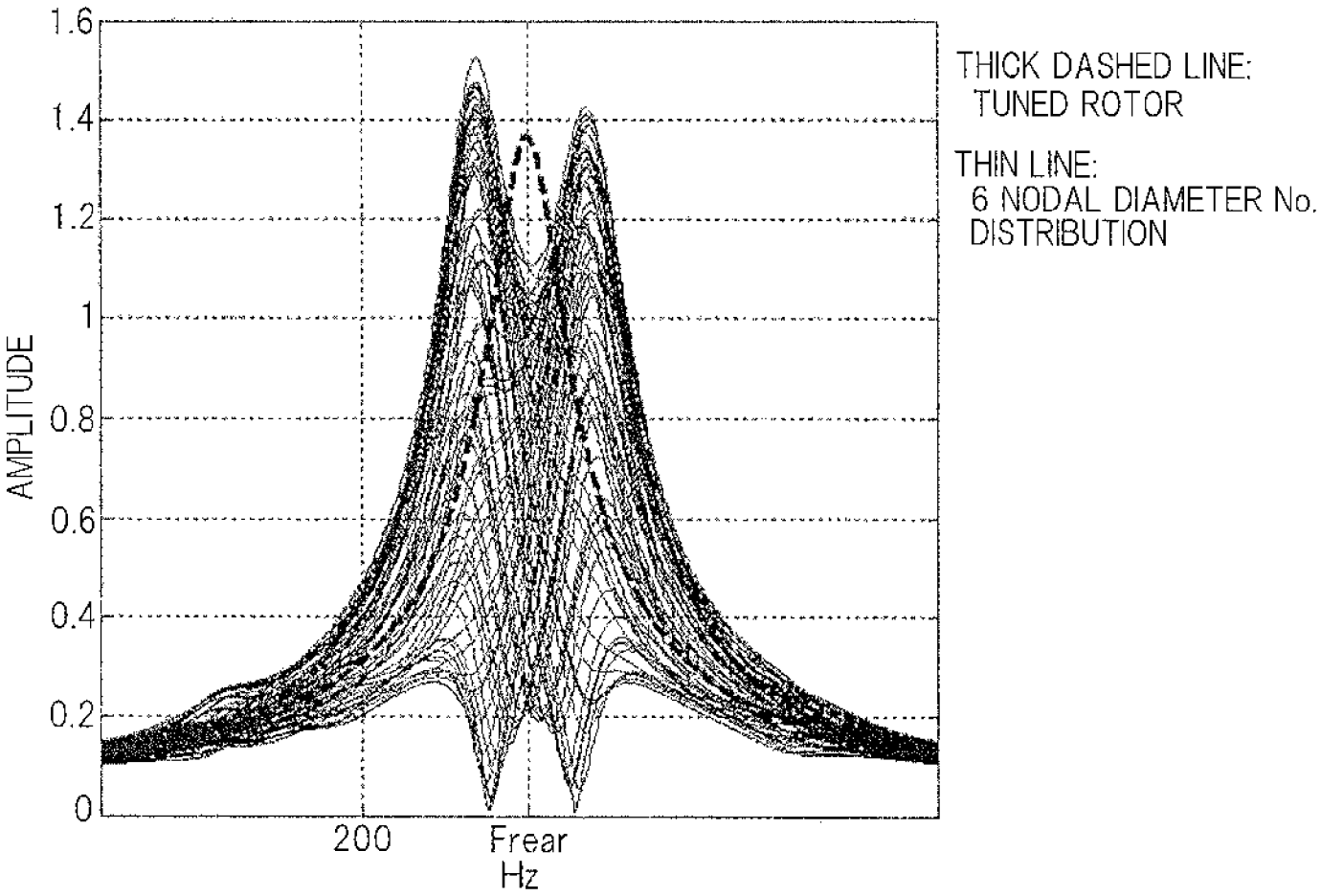
FIG. 16 is a graph showing, among the vibration response curves of FIG. 15, curves corresponding to nodal diameter number $N_f$=3 for an exciting force, which curves are superposed with respect to all 74 blades.
Figure 17:
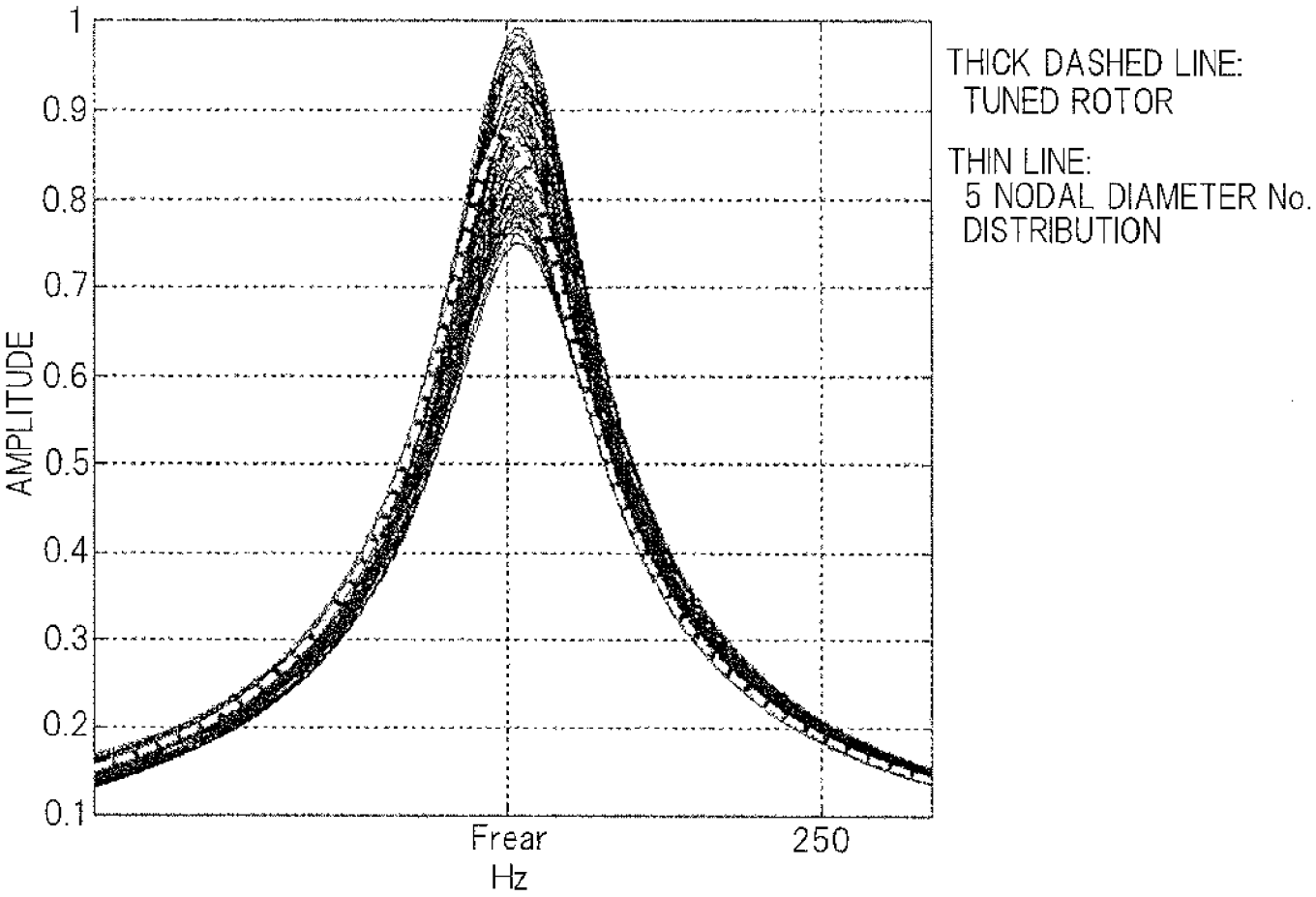
FIG. 17 is a graph showing, among the vibration response curves of FIG. 15, curves corresponding to nodal diameter number $N_f$=6 for an exciting force, which curves are superposed with respect to all 74 blades.

In FIG. 13, FIG. 14, and FIG. 15, solid lines represent vibration response curves for respective exciting forces ($F_1$ to $F_8$) applied to a turbine rotor in a case where rotor blades are arranged with the nodal diameter numbers of $N_d$=4, $N_d$=5, and $N_d$=6 for mass distribution of the rotor blades, respectively. Each response curve is obtained by calculating the vibration responses of all the 74 rotor blades, and connecting the amplitudes of the blades having the greatest vibrations for each excitation frequency. Of the response curves shown in FIG. 15 in which $N_d$=6, an attention is focused on the responses corresponding to the nodal diameter numbers of $N_f$=3 and $N_f$=6 regarding the exciting force, and all the vibration responses of the 74 blades are superposed, resulting in solid lines shown in FIG. 16 ($N_f$=3) and FIG. 17 ($N_f$=6), respectively. In FIG. 13, FIG. 14, FIG. 15, FIG. 16, and FIG. 17, dashed lines (in FIG. 17, white dashed line) are obtained by superposing the response curves of the tuned rotor shown in FIG. 12.

In the example of the tuned rotor shown in FIG. 12, only the vibration mode in which the distribution pattern (nodal diameter number) of the exciting force coincides with the disk-mode vibration pattern (nodal diameter number) of the rotating body, provides strong resonance (critical resonance). On the other hand, in the examples shown by the solid lines in FIG. 13, FIG. 14, and FIG. 15, which include mistuned components, a peak of vibration response occurs even at a frequency apart from the critical resonance frequency of the tuned rotor. When an attention is focused on a difference between each solid line and each dashed line in FIG. 13, FIG. 14, and FIG. 15, it is found that there are cases where the vibration response of the mistuned rotor causes stronger resonance than the tuned rotor and where the resonance frequency of the mistuned rotor is modulated from that of the tuned rotor.

Through consideration of the above-mentioned analysis result, it is found that, in the rotating body having the grouped blade structure (infinite grouped blades) in which blades are connected over the entire circumference thereof, like the tip shroud blades shown in FIG. 1, if the rotating body has variation in mass distribution, a mistuned component of an arbitrary nodal diameter number obtained by decomposing the mass distribution with Fourier series expansion has the following features on vibration of the rotating body. Further, similar analysis was performed on rotating bodies having variations in rigidity distribution and frequency distribution, and it is confirmed that similar features are provided in each case.

1) The mistuned component of the arbitrary nodal diameter number increases the critical resonance of the same nodal diameter number as that of the mistuned component.

2) A mistuned component having an even nodal diameter number causes peaks, at two frequencies, of critical resonance of nodal diameter number half (1/2) the nodal diameter number of the mistuned component, and increases the resonance. In this case, the critical resonance at the lower frequency is more likely to increase as compared to the critical resonance at the higher frequency.

3) A mistuned component having an even nodal diameter number increases critical resonance of nodal diameter number "close to" 1/2 of the nodal diameter number of the mistuned component, and modulates the frequency of the critical resonance toward a side away from the frequency of the critical resonance of the nodal diameter number half (1/2) the nodal diameter number of the mistuned component. These functions tend to occur more strongly at a frequency closer to the frequency of the critical resonance having the nodal diameter number half (1/2) the nodal diameter number of the mistuned component, and there is a tendency that the critical resonance at the lower frequency is stronger than the critical resonance at the higher frequency.

4) A mistuned component having an odd nodal diameter number "significantly" increases the critical resonance of nodal diameter number "close to" 1/2 of the nodal diameter number of the mistuned component, and modulates the frequency of the critical resonance to a side apart from the frequency of the critical resonance of the nodal diameter number half (1/2) the nodal diameter number of the mistuned component. These functions tend to occur more strongly at a frequency closer to the frequency of the critical resonance having the nodal diameter number half (1/2) the nodal diameter number of the mistuned component, and there is a tendency that the critical resonance at the lower frequency is stronger than the critical resonance at the higher frequency.

5) The above-mentioned functions overlap each other. Therefore, in resonance in mistuned distribution in which the nodal diameter number of the mistuned component is close to half (1/2) the nodal diameter number, specifically, for example, mistuned distribution in which the nodal diameter number of the mistuned component is about 1 to 4, the vibration amplitude is more likely to be increased as compared to that in the tuned rotor.

6) When a plurality of nodal diameter number components overlap each other, the above-mentioned functions, caused by mistuning, also tend to overlap each other.

7) In the mistuned rotor, resonance occurs even at a frequency at which no resonance occurs in the tuned rotor having ideal infinite grouped blades. In particular, resonance occurs at various frequencies, including resonance of relatively small response.

While mistuning acts disadvantageously for the vibration strength of the rotating body, not a little mistuning generally exists in actual products. In the present invention, a causal relationship between cause (mistuning) and phenomenon (change in vibration characteristic) caused thereby is clarified, thereby providing means and structures for effectively suppressing increase in rotor blade vibration caused by mistuning, and easily and effectively realizing avoidance of critical resonance. Generally, when critical resonance occurs at the nodal diameter number of two or less, risk of damage is particularly high. Therefore, a design which causes no damage even when critical resonance occurs at the nodal diameter number of two or less is difficult and disadvantageous in cost in many cases. In addition, it is also disadvantageous in cost to realize, as an actual product, an ideal tuned rotor having no variation in mass or the like.

Figure 18:
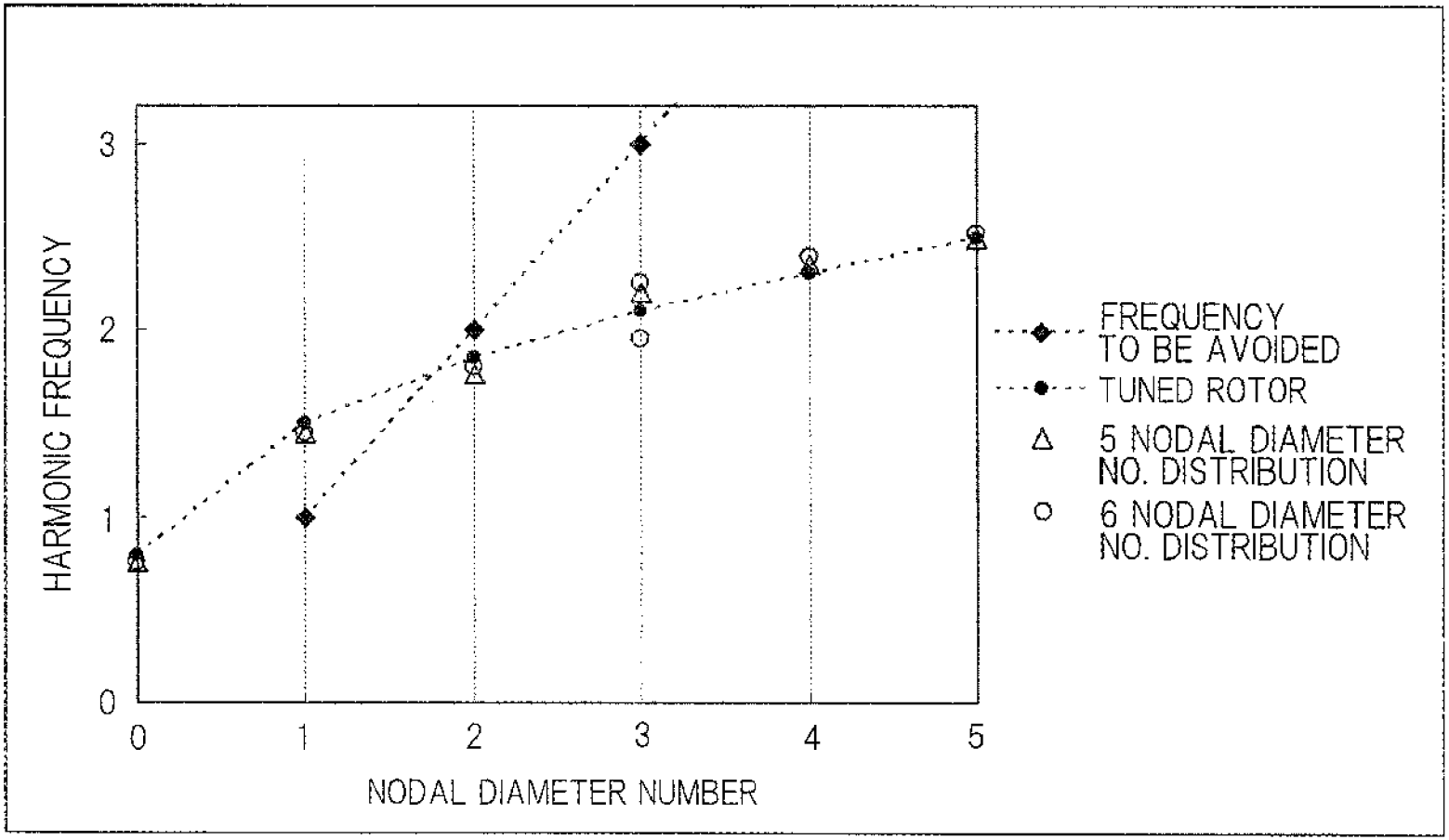
FIG. 18 is a graph showing an example of a vibration design in which resonance is avoided on a side where a resonance frequency under a two nodal diameter number mode of a rotating body is lower than a rotational secondary harmonic frequency with respect to a rated rotation speed.
Figure 19:
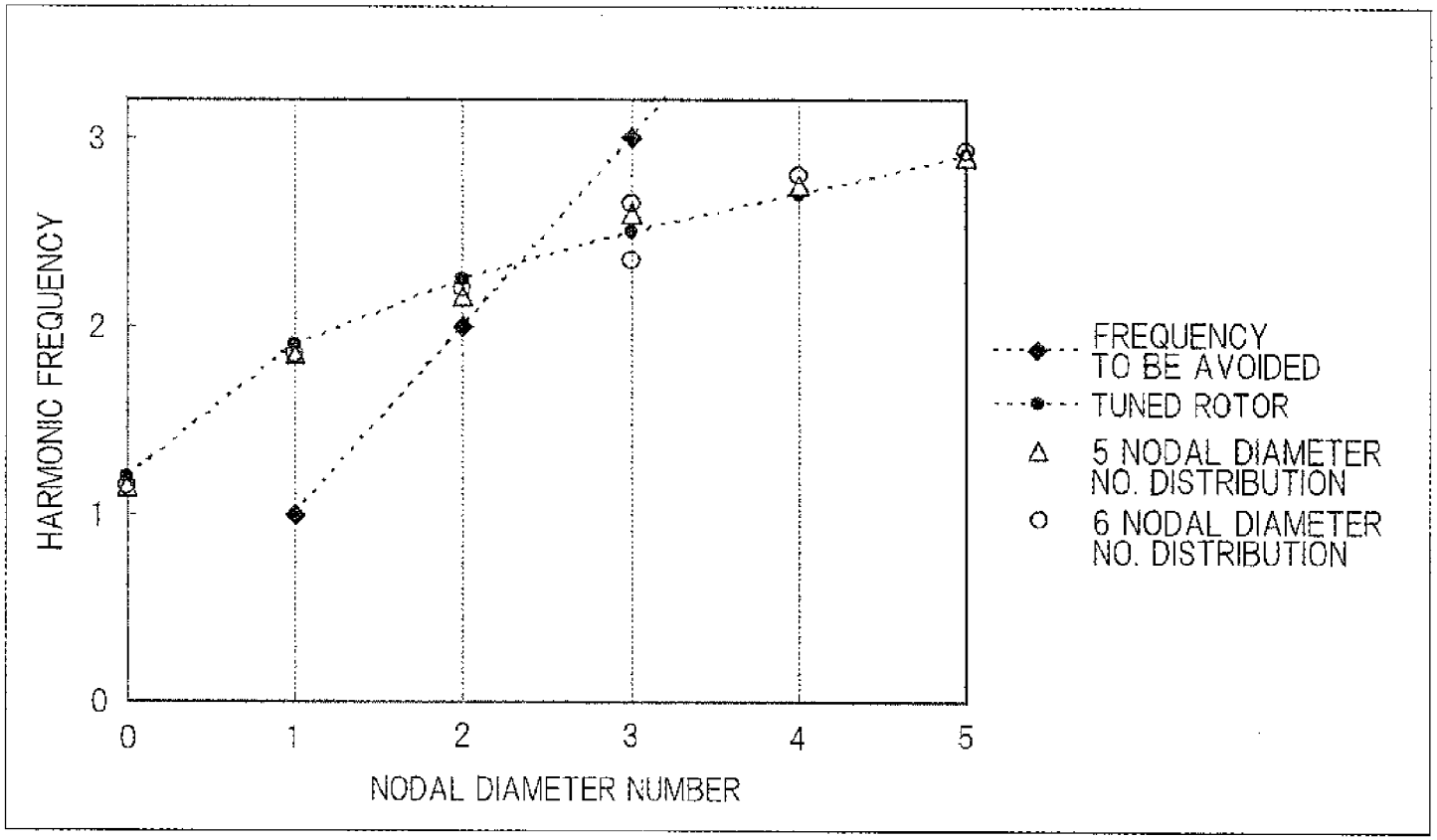
FIG. 19 is a graph showing an example of a vibration design in which resonance is avoided on a side where a resonance frequency under a two nodal diameter number mode of a rotating body is higher than a rotational secondary harmonic frequency with respect to a rated rotation speed.
Figure 20:
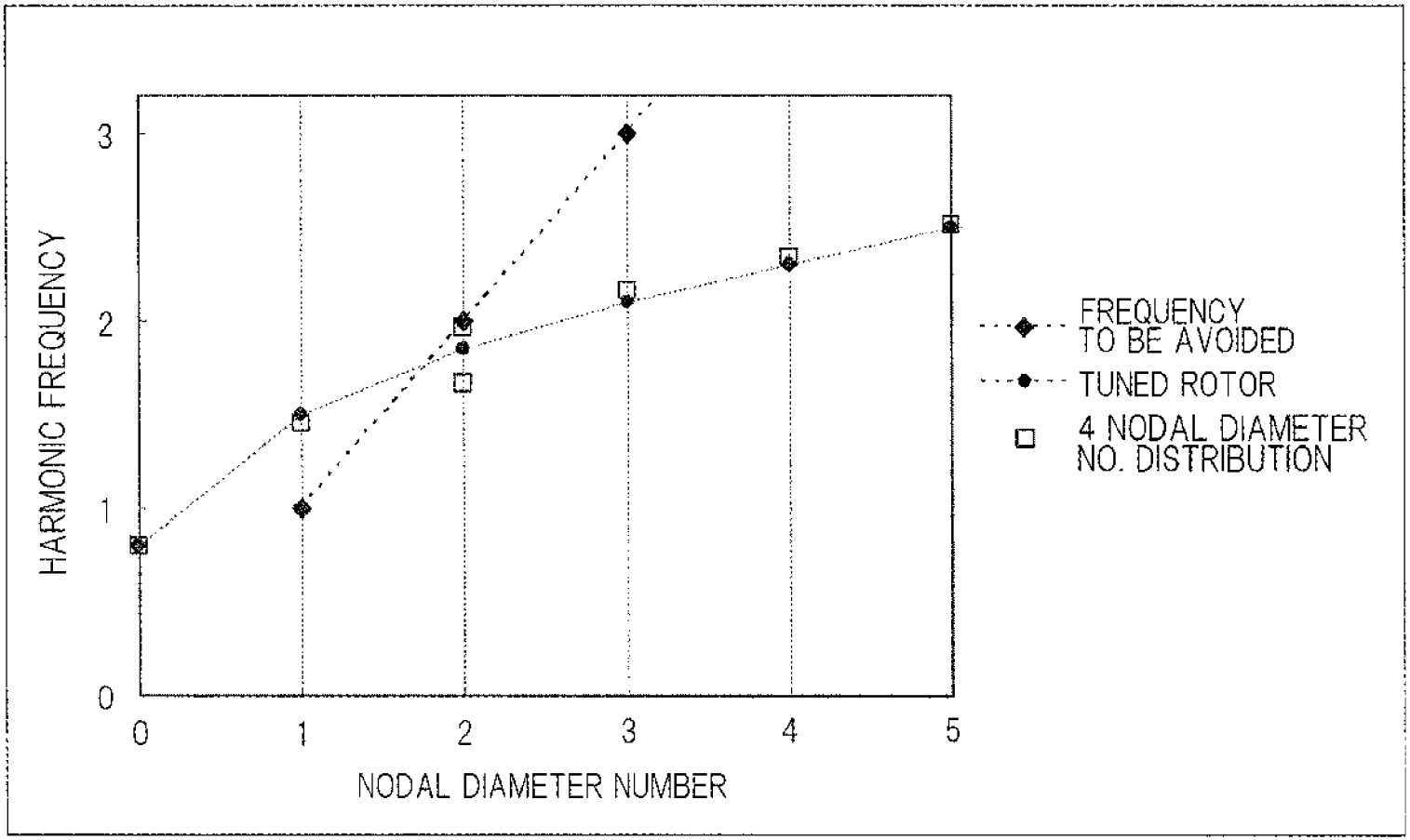
FIG. 20 is a graph showing an example of a design in a case where mass distribution is four nodal diameter number distribution in the same rotating body as in FIG. 18.

FIG. 18 and FIG. 19 show examples of vibration design of the turbine rotor 1 shown in FIG. 1. Specifically, the design is intended to avoid critical resonance frequencies of the nodal diameter number of one and the nodal diameter number of two, and to suppress increase in resonance. FIG. 20 shows the same design model as that shown in FIG. 18 except that arrangement of mistuned components is changed. In FIG. 18, FIG. 19, and FIG. 20, the horizontal axis represents the nodal diameter number corresponding to the natural vibration mode of the rotating body, and the nodal diameter number of the fluid exciting force, and the vertical axis represents the order of the harmonic frequency (nondimensional frequency) of the turbine rotor, and the nondimensional frequency of the fluid exciting force. Each black diamond indicates the nodal diameter number of the fluid exciting force acting on the rotating body, and the excitation frequency which is to be avoided. Each black circle plotted in the graph indicates a coordinate point of the nodal diameter number and the resonance frequency under the vibration mode of the tuned rotor. A white triangle and a white circle plotted indicate resonance frequencies in the case where mass variation corresponds to mistuned components having the nodal diameter number of five and the nodal diameter number of six, respectively, as examples of arrangement of mistuned components. That is, each black diamond indicates the conditions (nodal diameter number, frequency) of the critical resonance when the rotating body performs rated rotation. When a black diamond and a white triangle or a white circle indicating the vibration mode of the rotating body get close to each other, the rotating body enters the state of the critical resonance. Each white rectangle shown in FIG. 20 indicates an example in the case where, in the same rotating body as in FIG. 18, arrangement of mistuned components has the nodal diameter number of four.

FIG. 18 shows an example in which resonance is avoided on the side where the resonance frequency under the two nodal diameter number mode of the turbine rotor 1 is lower than the rotational secondary harmonic frequency with respect to the rated rotation speed. In this case, the resonance frequency under the two nodal diameter number mode of the mistuned rotor is modulated toward a side (safe side) going away from the critical resonance frequency of the two nodal diameter number as compared to the resonance frequency of the tuned rotor, for both the five nodal diameter number distribution and the six nodal diameter number distribution. Although the frequency width to be modulated is small, since this modulation acts in the direction of canceling the resonance increasing effect in the rated rotation speed, the risk of damage of the rotor blades due to mistuning is reduced. The modulation width from the resonance frequency of the tuned rotor is slightly smaller in the six nodal diameter number distribution than in the five nodal diameter number distribution. However, since the amplitude in the resonance frequency is smaller in the six nodal diameter number distribution than in the five nodal diameter number distribution, the risk of damage with respect to the frequencies corresponding to the black diamonds can be consequently determined to be substantially the same as that of the five nodal diameter number distribution.

FIG. 19 shows an example in which resonance is avoided on the side where the resonance frequency under the two nodal diameter number mode of the turbine rotor 1 is higher than the rotational secondary harmonic frequency with respect to the rated rotation speed. In this case, the resonance frequency under the two nodal diameter number mode of the mistuned distribution is modulated toward a side (critical side) approaching the critical resonance frequency of the two nodal diameter number from the resonance frequency of the tuned rotor, for both the five nodal diameter number distribution and the six nodal diameter number distribution. However, the six nodal diameter number distribution has smaller modulation than the five nodal diameter number distribution, and therefore, has higher robustness against mistuning. Accordingly, in this design example, the six nodal diameter number distribution is desirable.

FIG. 20 shows an example in which the mass distribution is the four nodal diameter number distribution in the same turbine rotor as that of FIG. 18. In the four nodal diameter number distribution, the peak of the critical resonance of the two nodal diameter number is separated into two peaks, and the frequency range in which strong resonance occurs is increased, and moreover, one of the peaks is significantly modulated toward the side (critical side) of the higher frequency. Thus, the risk of damage is remarkably high as compared to the rotor blades arranged in the five nodal diameter number distribution and the six nodal diameter number distribution.

Figure 21:
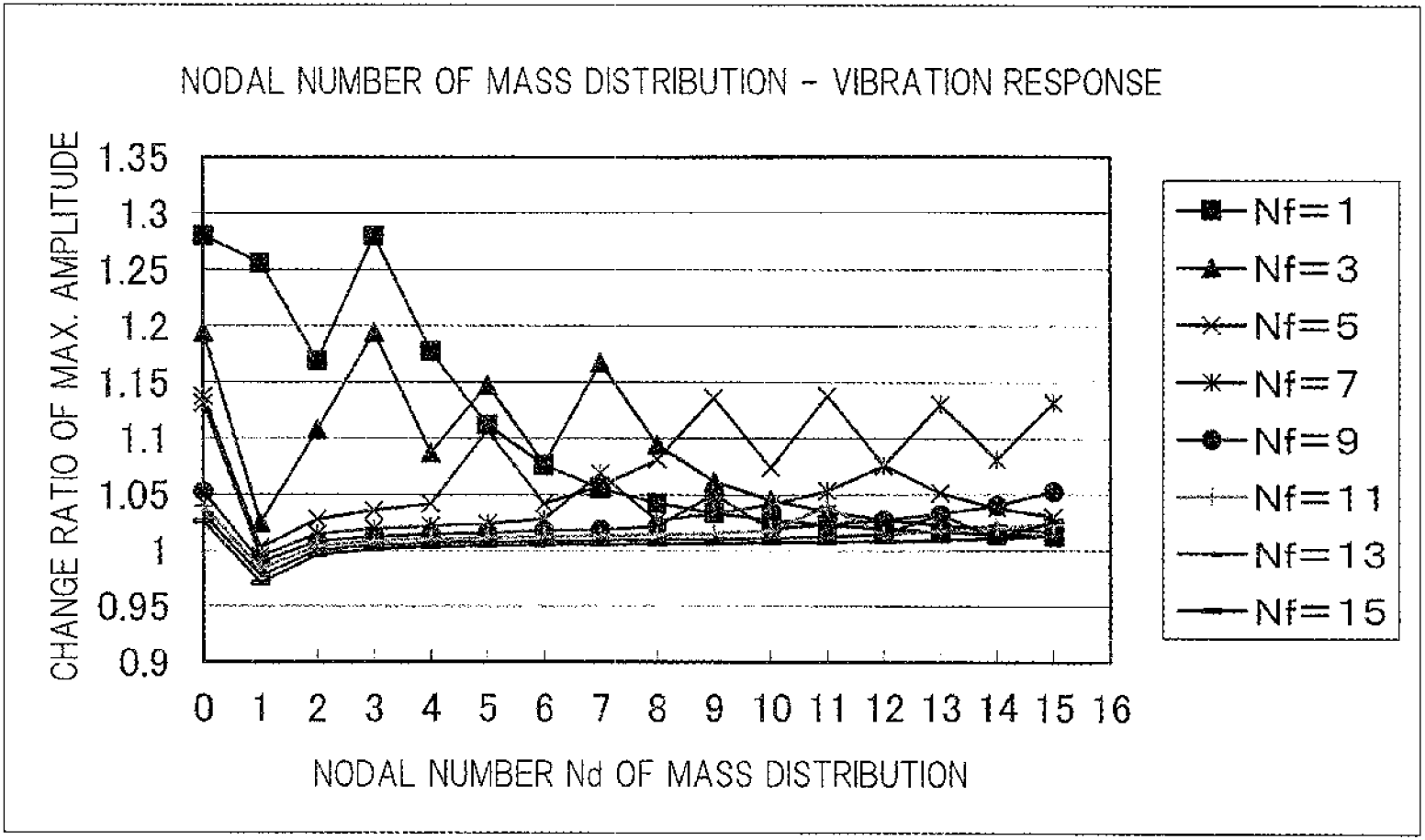
FIG. 21 is a graph showing an analysis result regarding an effect of nodal number of mass distribution.

FIG. 21 is a graph in which, regarding the analysis model of FIG. 9 simulating FIG. 1, the nodal number $N_d$ of mass distribution is plotted on the horizontal axis, and the resonance increasing effect of the critical resonance amplitude due to mistuning, i.e., the ratio of change in the maximum amplitude of the tuned rotor having no variation in mass and the mistuned rotor, is plotted on the vertical axis. As evident from the features shown in FIG. 18, there is a tendency that, the larger the nodal diameter number $N_d$ is, the more the resonance increasing effect due to mistuning is suppressed. However, as described above, in determining the arrangement of the mistuned components of the rotor blades by intentionally selecting the nodal diameter number $N_d$, there is an advantageous range regarding the cost, depending on the rotor. Therefore, in many cases, the nodal diameter number $N_d$ is desired to be close to five or six.

The turbine rotor blades B of the present embodiment are formed separately from the disk-shaped rotating body core D, and then implanted in the outer peripheral portion of the rotating body core D. This configuration makes it easy to provide the turbine rotor blades B so as to form specific mass distribution on the rotating body core D.

As described above, according to the turbine rotor 1 of the present embodiment, mistuned components of masses or the like of multiple blades, provided at equal intervals on the rotating body core, are intentionally arranged, whereby vibration of the rotor blades B caused by mistuning is extremely effectively suppressed.

Figure 22:
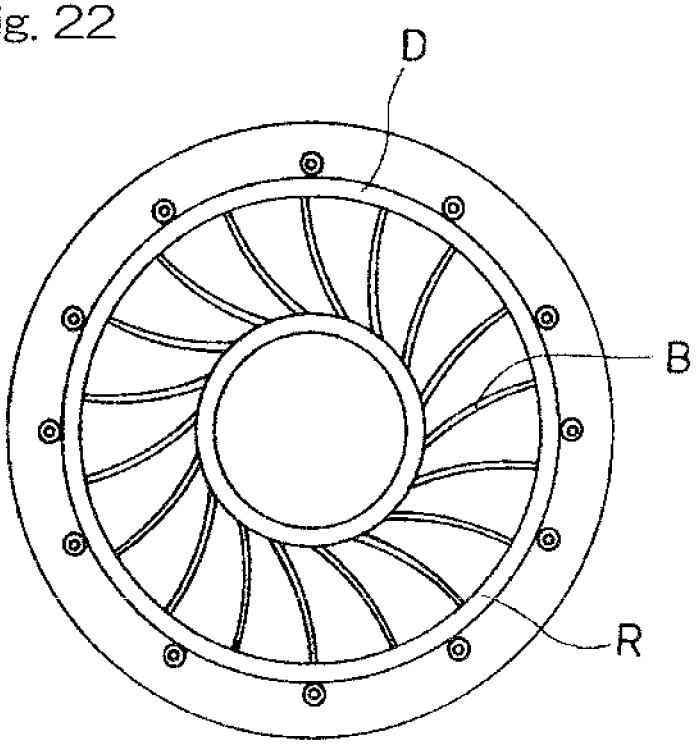
FIG. 22 is a front view of a rotating body (turbine rotor) according to another embodiment of the present invention.

The "rotating body core" of the rotating body to which the present invention is applied is not limited to a core formed on the inner circumferential side of the rotor blades B like the rotating body core D shown in FIG. 1. A rotating body is generally included which has a grouped blade structure in which the turbine rotor blades B arranged so as not to include a rotation axis and arrayed on the inner circumferential side of the rotating body core D are connected to adjacent blades in the circumferential direction over the entire circumference, at portions other than the connection portions to the rotating body core D. For example, as shown in FIG. 22, a plurality of rotor blades B may be arrayed over the inner circumference of an annular rotating body core D, and connected to each other over the entire circumference via a ring-shaped connection portion R provided separately from the core D. This structure is also within the scope of the embodiment of the present invention.

Further, in the present embodiment, a turbine rotor of a gas turbine engine is described as an example of a rotating body. However, the present invention is not limited thereto, and can be applied to any rotating body which is provided with a plurality of blades and is used for turbomachinery such as a steam turbine and a jet engine.

Although the present invention has been described above in connection with the preferred embodiments thereof with reference to the accompanying drawings, numerous additions, changes, or deletions can be made without departing from the gist of the present invention. Accordingly, such additions, changes, or deletions are to be construed as included in the scope of the present invention.

REFERENCE NUMERALS

1 . . . Turbine rotor (Rotating body)
B . . . Turbine rotor blade (blade)
D . . . Rotating body core

What is claimed is:

1. A rotating body comprising:

a rotating body core; and a plurality of blades provided at an outer circumference or an inner circumference of the rotating body core at equal intervals in a circumferential direction, the plurality of blades forming a grouped blade structure in which the blades are connected over the entire circumference via an annular connection portion provided separately from the rotating body core, wherein a resonance frequency under a two nodal diameter number mode of the rotating body is lower than or equal to a rotational secondary harmonic frequency with respect to a rated rotation speed of the rotating body, and where an order of a maximum mistuned component is defined as $N_d$ among order components of mass distribution, rigidity distribution, or natural frequency distribution of the plurality of blades in the circumferential direction, the plurality of blades are arranged so as to satisfy $N_d \geq 5$, and arranged so as to have order components each having a ratio less than 1/2, in which the ratio is obtained by dividing the order component by a magnitude of the component of the order $N_d$.

2. A rotating body comprising:

a rotating body core; and a plurality of blades provided at an outer circumference or an inner circumference of the rotating body core at equal intervals in a circumferential direction, the plurality of blades forming a grouped blade structure in which the blades are connected over the entire circumference via an annular connection portion provided separately from the rotating body core, wherein a resonance frequency under a two nodal diameter number mode of the rotating body is higher than a rotational secondary harmonic frequency with respect to a rated rotation speed of the rotating body, and where an order of a maximum mistuned component is defined as $N_d$ among order components of mass distribution, rigidity distribution, or natural frequency distribution of the plurality of blades in the circumferential direction, the plurality of blades are arranged so as to satisfy $N_d \geq 6$, and arranged so as to have order components each having a ratio less than 1/2, in which the ratio is obtained by dividing the order component by a magnitude of the component of the order $N_d$.

3. The rotating body as claimed in claim 1, wherein the rotating body core and the plurality of blades are formed separately from each other, and the blades are implanted in the rotating body core.

4. The rotating body as claimed in claim 2, wherein the rotating body core and the plurality of blades are formed separately from each other, and the blades are implanted in the rotating body core.

5. A method of manufacturing a rotating body which includes: a rotating body core; and a plurality of blades provided at an outer circumference or an inner circumference of the rotating body core at equal intervals in a circumferential direction, the plurality of blades forming a grouped blade structure in which the blades are connected over the entire circumference via an annular connection portion provided separately from the rotating body core, wherein a resonance frequency under a two nodal diameter number mode of the rotating body is lower than or equal to a rotational secondary harmonic frequency with respect to a rated rotation speed of the rotating body, the method comprising:

where an order of a maximum mistuned component is defined as $N_d$ among order components of mass distribution, rigidity distribution, or natural frequency distribution of the plurality of blades in the circumferential direction, arranging the plurality of blades so as to satisfy $N_d \geq 5$, and so as to have order components each having a ratio less than 1/2, in which the ratio is obtained by dividing the order component by a magnitude of the component of the order $N_d$.

6. A method of manufacturing a rotating body which includes: a rotating body core; and a plurality of blades provided at an outer circumference or an inner circumference of the rotating body core at equal intervals in a circumferential direction, the plurality of blades forming a grouped blade structure in which the blades are connected over the entire circumference via an annular connection portion provided separately from the rotating body core, wherein a resonance frequency under a two nodal diameter number mode of the rotating body is higher than a rotational secondary harmonic frequency with respect to a rated rotation speed of the rotating body, the method comprising:

where an order of a maximum mistuned component is defined as $N_d$ among order components of mass distribution, rigidity distribution, or natural frequency distribution of the plurality of blades in the circumferential direction, arranging the plurality of blades so as to satisfy $N_d \geq 6$, and so as to have order components each having a ratio less than 1/2, in which the ratio is obtained by dividing the order component by a magnitude of the component of the order $N_d$.

7. The method of manufacturing a rotating body as claimed in claim 5 further comprising: forming the rotating body core and the plurality of blades separately from each other; and implanting the blades so as to be arranged in the circumferential direction of the outer circumference or the inner circumference of the rotating body core.

8. The method of manufacturing a rotating body as claimed in claim 6 further comprising: forming the rotating body core and the plurality of blades separately from each other; and implanting the blades so as to be arranged in the circumferential direction of the outer circumference or the inner circumference of the rotating body core.

* * * * *